US007563210B2

(12) United States Patent
Smith

(10) Patent No.: US 7,563,210 B2
(45) Date of Patent: Jul. 21, 2009

(54) GYROSCOPIC TOTAL EXERCISER

(76) Inventor: Tom Smith, 1144 N. Grove St., Anaheim, CA (US) 92806

( * ) Notice: Subject to any disclaimer, the term of this patent is extended or adjusted under 35 U.S.C. 154(b) by 0 days.

(21) Appl. No.: 12/072,776

(22) Filed: Feb. 28, 2008

(65) Prior Publication Data

US 2008/0242508 A1 Oct. 2, 2008

Related U.S. Application Data

(60) Provisional application No. 60/920,250, filed on Mar. 27, 2007.

(51) Int. Cl.
*A63B 21/22* (2006.01)

(52) U.S. Cl. ..... 482/110

(58) Field of Classification Search ..... 482/110
See application file for complete search history.

(56) References Cited

U.S. PATENT DOCUMENTS 5,800,311 A * 9/1998 Chuang ..... 482/44
6,053,846 A * 4/2000 Lin ..... 482/44
7,033,304 B2 * 4/2006 Chuang et al. ..... 482/45
7,175,573 B1 * 2/2007 Huang ..... 482/110
2005/0101454 A1 * 5/2005 Dworzan ..... 482/110

* cited by examiner

*Primary Examiner*—Loan H Thanh
*Assistant Examiner*—Shila Abyaneh
(74) *Attorney, Agent, or Firm*—Clement Cheng

(57) ABSTRACT

A gyroscopic exercise device has a pair of handles attached to a housing. A user holds and rotates the handles along cone-like paths causing precession of a rotor, which is rotating about its spin axis, to provide resistance to the user. The device has an axle disc that holds ends of an axle of the rotor. The periphery of the axle disc and the ends of the rotor axle are within a circular race in the housing. A motor attached to the axle disc has a wheel for rotating the rotor about a spin axis by a temporary supply of power from included batteries in one of the handles. The batteries are in between two opposite springs in one of the handles and normally biased away from an electrical contact until the user pushes them through an end pin to overcome the bias.

23 Claims, 10 Drawing Sheets

FIG. 9 FIG. 10
FIG. 8
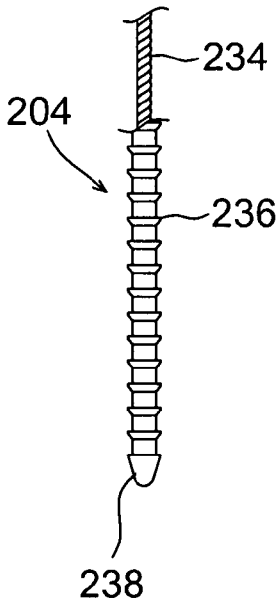
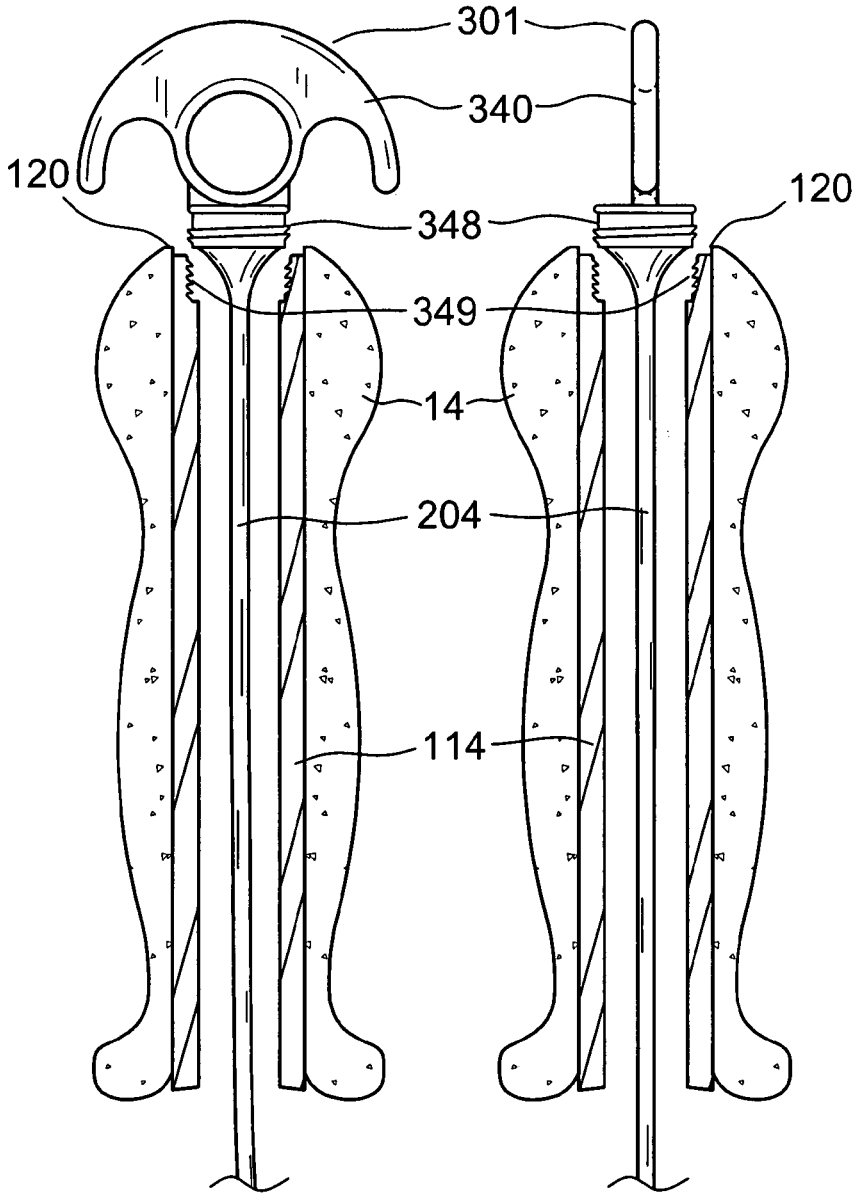

GYROSCOPIC TOTAL EXERCISER

This application claims priority from provisional application for SMITH, Tom 60/920,250 entitled Gyroscopic Total Exerciser filed Mar. 27, 2007.

BACKGROUND OF THE INVENTION

A. Field of the Invention

The present invention relates generally to exercise devices and, in particular, to a gyroscopic device for a holistic physical exercise which is structured to accommodate either a sophisticated electrical motor-driven starter or a simple hand-pull starter to gain the necessary precession speed.

B. Description of the Prior Art

Gyroscopic exercisers have been known and developed in the hopes to provide dynamic physical exercises that benefit men and women in real life situations. Firefighters must often exert their muscle forces to the limit, as do most competitive athletes. In everybody's daily lives, people use muscles in any tasks from light chores such as lifting grocery bags to heavy duties like snowplowing. Gyroscopic exercisers were developed with the acknowledgement that most conventional weight lifting techniques and equipments isolate muscles and provide little benefit outside the gym. However, conventional gyroscopic exercisers too have limited applications to hand and its proximal muscle regions rather than the whole body. Devices have attempted to use gyroscopic forces to assist in developing and strengthening selected muscles of the human body. The gyroscopic effect, or precession, of a rapidly spinning mass is capable of producing a strong torque if the user attempts to move the mass in a way which rotates its spin axis.

U.S. Pat. No. 3,617,056 to Herbold is directed to a dumbbell that utilizes the precessional force generated by two spinning weighted discs to enhance the effect of the exercising movements. This device, however, is used basically for exercising the hands and arms of the user.

The precession driven gyroscopic wrist exerciser was first invented by Archie L. Mishler and patented Apr. 10$^{th}$, 1973 in U.S. Pat. No. 3,726,146. For those unfamiliar with the gyroscopic wrist exerciser mechanism, the Mishler reference abstract provides an excellent primer regarding the kinematic physics. Jerrold W. Silkebakken further improved precessional stability adding a sectioned ring within the race patented Apr. 24, 1979 in U.S. Pat. No. 4,150,580.

U.S. Pat. No. 4,703,928 is directed to a gyroscopic exercising device that utilizes a housing containing a spinning mass, which forms the rotor of a motor for spinning the mass. The spin axis of the mass is perpendicular to the upper and lower surfaces of the housing. A footplate, mounted for rotation about two mutually orthogonal axes, is mounted such that rotational movement of the foot is opposed by the gyroscopic effect of the spinning mass, producing an isometric exercise effect. Although this device can be used on any limb of the body or the torso, it does not permit several muscle groups of the body to be exercised simultaneously.

Two exercisers disclosed by U.S. Pat. Nos. 4,150,580 and 5,353,655 closely resemble the commercially available 'Gyro Exercisers' being used to develop the gripping force of hands. Because these exercisers concern hand and wrist movements they are commonly structured to produce a compact precession phenomenon using the gyroscopic disk in the shape of a hollowed out small rotor and a support means with an interior circular race and an exterior round grip surfaces all in a package of a size and weight to fit in the palm of a user. U.S. Pat. No. 4,703,928 to Escher discloses a similarly limiting hand exerciser with possible adaptations of the same to multiple moving parts of the body. But the attachments for customizing are overwhelming and might need a substantial space to have them all together let alone keeping them portable.

All these efforts came short of providing an able gyroscopic exerciser that can be actually used to enhance limb exertions and performances of different muscles of the user's body (e.g., back muscles, deltoids, pectorals, biceps, and triceps). Such device will be able to exercise various large muscle groups simultaneously for the user to obtain vigorous resistance and cardiovascular exercise.

Additionally, there is a need for an improved gyroscopic exercise device that has a starting means to attain the threshold rotor speed for precession and a reliable mechanism for operatively supporting high speed rotational components for an extended length of product life requiring little or no technical maintenance except routine lubrications and battery changes.

Then, the present inventor has disclosed a radical design of a body scale gyroscopic exerciser in US Patent Pub. No. 2005/0101454 dated May 12, 2005 with application Ser. No. 10/693,338 filed on Oct. 24, 2003. The present invention is an improvement to the earlier embodiments disclosed and provides a total gyroscopic exerciser with many aspects of substantial adjustments.

An object of the present invention is to provide a gyroscopic total exerciser that has a starting means to attain the threshold rotor speed for precession wherein pleasant pedaling movements of either arms or legs produce the gyroscopic activation of the exercising device, which in response increases the dynamically resistive weight for muscles from hands or legs to torso of the exerciser to build up the explosive muscular strength as well as the muscle masses.

Previously, the prior art had gyroscopic exercisers that were either difficult to start because of the complicated glitchy and underpowered electrical apparatus required to start it, or conversely the gyroscopic exercisers that were easy to start were low powered and lightweight compared to the heavier ones. Therefore, the main point of this invention is to have a heavy rotor gyroscopic exerciser that is heavy enough to work out both arms, yet still easy to start by a beginner if.

Another object of the present invention is to provide a gyroscopic total exerciser with a starting means for initializing a precession movement using an interchangeable power source from either an electrical motor or manual force depending on the different needs of convenience by different groups of users.

Yet another embodiment of the present invention is to provide an improved handheld gyroscopic exercise device that is easier to manufacture and needs only minor maintenance of periodic lubrications with an extended product life.

SUMMARY OF THE INVENTION

A gyroscopic exercise device has a pair of handles attached to a housing. One of the handles holds a power supply to start the gyroscopic movement. A user holds and rotates the handles along a cone-like path causing precession of a rotor, which is rotating about its spin axis, to provide resistance to the user.

Inside the housing there are a gyroscopic movement unit having a precession rotor of a truncated and recessed sphere with an internal axle protruding at opposite directions and held to make a rotation about a spin axis extending perpendicular to the handles as well as a revolution about a precession axis extending centrally of the handles; an annular racetrack of a generally U-shaped cross section for rotatably holding the spin axle at its opposite ends about the precession axis crossing the longitudinal center of the spin axis; an axle disc having internal openings to receive the axle of the rotor and a circumferential edge received in the racetrack for corotation with the axle; a driving motor pivotally mounted on the axle disc for engaging an axially recessed circular track of rotor to initialize the rotation of the rotor as they revolve together about the precession axis and then effecting the precession movement; and a dynamic electrical connection for the motor to receive the electricity from the stationary power supply with a switch.

A ring-shaped frame assembly surrounds the housing and has an outer ring member with an annular flange and a smaller inner ring member received in the flange of the outer ring member and fastened thereto, both ring members having opposing annular recesses for cooperatively holding the top and bottom halves of the racetrack of the gyroscopic movement unit. And a pair of truss members fastens the handles to the frame assembly at two diametrically opposite locations from the inner and outer ring members. Each of the inner and outer ring members further has multiple circumferential indentations diametrically positioned for reducing the idle weight of the exercise device. In one or more indentations there may be formed oil inlets communicating with the racetrack for lubricating the inside of the gyroscopic movement unit in order to provide a quiet and smooth operation of the exercise device.

The dynamic electrical connection comprises the power supply batteries located in the relatively stationary handle, a power supply conduit, a means for biasing the batteries normally out of contact with the power supply conduit and a conductor member of two isolated contacts one above the other mounted on the axle disc of the gyroscopic movement unit and revolving about the precession axis. The power supply conduit comprises an outer, tubular conductive portion in contact with the top one of the contacts of the conductor member, an inner, tubular insulator and a pin shaped center conductor, which is inserted in the insulator and protrudes at its top and bottom to connect one of the opposite terminal polarities of the batteries to the bottom one of the contacts of the conductor member; the biasing means including a proximal spring in the handle for mechanically pushing the batteries away from contacting the top protrusion of the center conductor and a spring loaded switch at a distal interior end of the handle for a user's finger to push to establish a dynamic power supply while initializing the precession of the device.

The handle comprises a conveniently shaped grip of foam or similar elastic material and a frame tube of metal, which is insulated by the outer grip and conducts electricity to maintain an electric conduction from the terminals of the power supply batteries. The handle may be at least internally conductive to electrically connect the proximal spring and the distal spring loaded switch together while the batteries are normally suspended from making a circuit by the proximal spring except when the distal switch is depressed to establish the power line, which leads from the distal battery terminal via the spring loaded switch, the frame tube, the proximal spring, the outer tubular conductive portion of the power supply conduit, the bottom one of the contacts of the revolving conductor member to both terminals of the motor and back via the top one of the revolving contacts and the center conductor to the opposite battery terminal.

In a non-electrical embodiment of the present invention, a gyroscopic exercise device comprises a pair of opposite handles for holding by upper or lower extremities of a user, both handles having interior cavities communicating with each other to accommodate a manual pull starter to cause a gyroscopic start; a gyroscopic movement unit between the handles having a precession rotor of a truncated and recessed sphere with an internal axle protruding at opposite directions and held to make a rotation about a spin axis extending perpendicular to the handles as well as a revolution about a precession axis extending centrally of the handles, an annular racetrack of a generally U-shaped cross section for rotatably holding the spin axle at its opposite ends about the precession axis crossing the longitudinal center of the spin axis, an axle disc having internal openings to receive the axle of the rotor and a circumferential edge received in the racetrack for corotation with the axle, the rotor having a deep middle groove that circumferentially extends from its peripheral surfaces and terminates short of the internal axle and a grip sleeve that defines the depth of the middle groove and is provided with toothed surfaces to positively engage at least part of the manual pull starter to initiate a high speed precession of the gyroscopic movement unit; a ring-shaped frame assembly having an outer ring member with an annular flange and a smaller inner ring member received in the flange of the outer ring member and fastened thereto, both ring members having opposing annular recesses for cooperatively holding the top and bottom halves of the racetrack of the gyroscopic movement unit; a spherical housing for protecting the gyroscopic movement unit from any physical contacts by the user or other external objects but permitting a view of gyroscopic movements of the unit from outside thereof; and a pair of truss members for fastening the handles to the frame assembly at two diametrically opposite locations from the inner and outer ring members.

An annular permanent magnet may be fixed stationary to the axle disc through an adjustable bracket at one side and a number of coil elements mounted to corotate with the axle of the rotor in a close proximity to the magnet for regenerating an electricity for storage in the power supply batteries to operate the motor at a later time as well as illuminate inside the gyroscopic movement unit. The stationary magnet closely cooperates with a number of coil and illuminating elements mounted rotatably with the axle of the rotor to generate an electricity for illuminating inside the gyroscopic movement unit during its operation.

There are also a number of through holes about the circular track of the rotor to cool both sides thereof. During manufacture of the device, a number of drilled reductions may be formed to balance the weight of the rotor for a smooth precession at any high speed.

Embodiments of the invention will now be described by way of example with reference to the accompanying drawings.

BRIEF DESCRIPTION OF THE DRAWINGS

FIG. 8 is an enlarged view of a pull starter tip encircled in C of FIG. 6 to show the detail of its sliding end and lateral teeth around core reinforcement.

FIG. 9 is a partial sectional view of a fourth embodiment of the exerciser of the invention having a manual pull starter with a built-in secure device for storage in the exerciser.

FIG. 10 is a view similar to FIG. 9 with the rotor and the pull starter turned 90 degrees about the axis of the handle to face forward.

Similar reference numbers denote corresponding features throughout the attached drawings.

DETAILED DESCRIPTION OF THE PREFERRED EMBODIMENT

Figure 1:
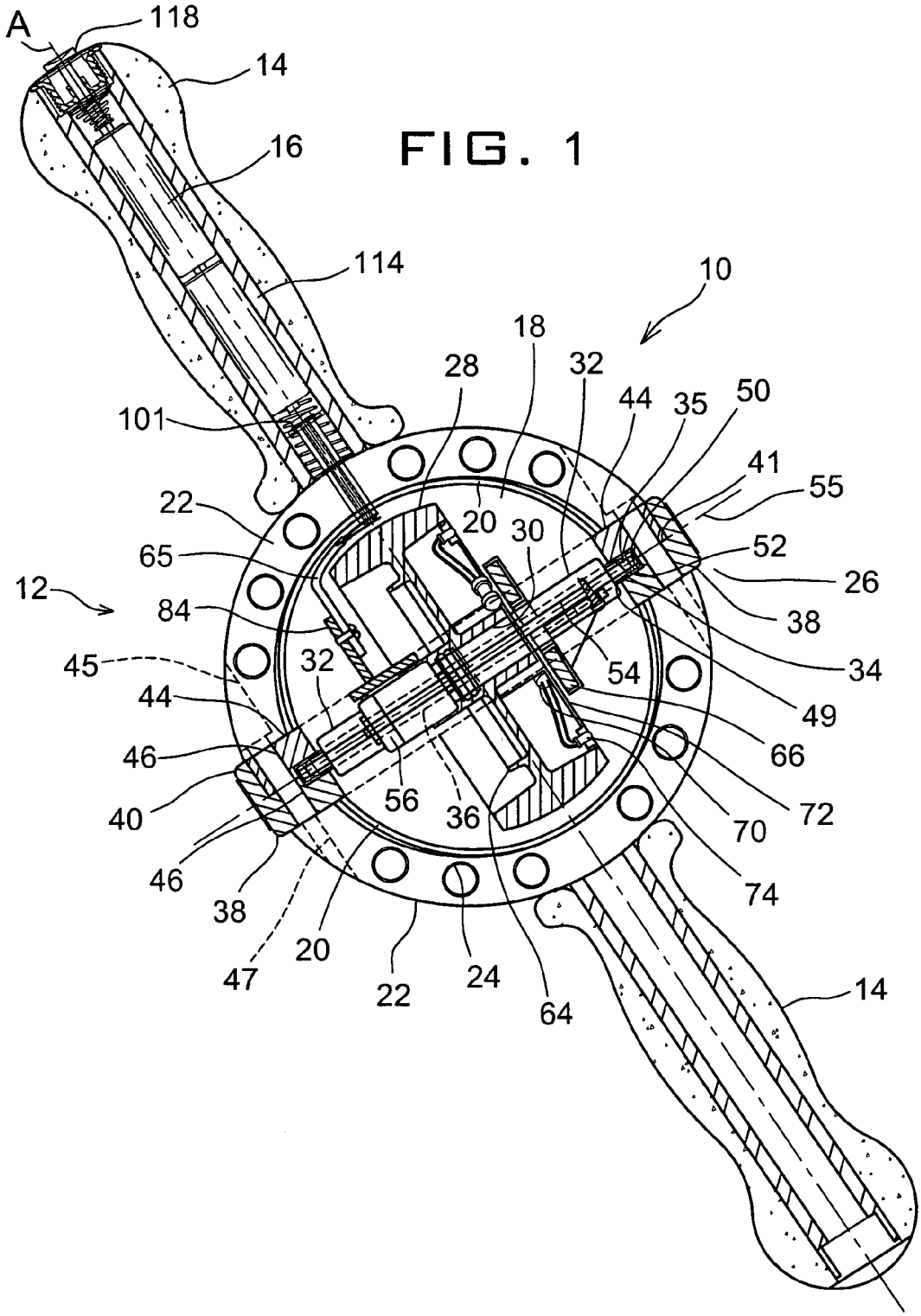
FIG. 1 is a partial longitudinal sectional view of a gyroscopic total exerciser according to a first embodiment of the present invention with the rotor and the disc positioned laterally.

For the sake of drawing placement, FIG. 1 shows the first embodiment of a gyroscopic exercise device 10 of the present invention oriented obliquely instead of normal horizontal position assumed during use thereof. The device 10 somewhat resembles a motorcycle handlebar including a central gyro sphere 12 and two diametrical handles 14 extending along a common axis A, which is concentric to the axis of precession and in turn the axis of uniquely dynamic and graceful body movements of the exerciser. One or both of the handles 14 may hold two AA-size batteries 16 inside to initialize the activation of the gyro sphere 12, which comprises a transparent or semi-transparent housing 18 for safely isolating the spinning components inside from the touch of a user but allowing the person a clear view of the operating status of the device 10.

The housing 18 may be divided into two identical semi-spherical shells 20 to which the handles 14 are attached through two suspension arches 22, respectively. Considering the high weight build-up upon reaching the revolution threshold at normal operation of the device 10, the arch 22 is preferably made of a solid metal block of aluminum and the like machined to provide the rounded outlines and multiple thru holes 24 for controlling the idle weight of the device 10. When assembled, the opposing arches 22 will bear most of the device's dynamic weight, which will be eventually taken and manipulated by the upper or lower extremities of the user. The holes 24 also allow air to whirl closely around the dynamic sphere of the exerciser 10 in operation in order to help dissipate frictional heat out of the housing 18.

Between the two laterally handled arches 22 interposed the gyro sphere 12 comprising a mounting frame 26 in the shape of a large ring to be positioned basically upright in front of the user who will hold the exerciser 10 by the side handles 14. The frame 26 is adapted to keep the gyroscopic movement of a core rotor 28 having two simultaneously rotational axes to provide the known precessional phenomenon as applied to the inventive device 10. The rotor 28 may be cast from a metal into the shape of a middle part of a solid sphere with two opposing apexes removed. The rotor 28 has a central sleeve 30 for fixedly receiving an axle 32 that extends in opposite directions to slightly pass the spherical boundary of the precessing rotor 28. The axle 32 becomes one of the two axes about which the rotor 28 may revolve freely in the gyro sphere 12. From both ends of the axle 32 concentric rolling tips 34 extend having their diameters abruptly reduced from the main portion of the axle 32. The tips 34 are then gradually reduced in diameter to provide rounded smooth ends 35 that effect minimum possible frictions due to their high speed relative movements to a racetrack 36 formed in the frame 26 to slidably guide the tips 34 during the rotor 28 operation. The radius of the tip 34 may be in the order of 0.5 to 1 mm and preferably 0.7 mm.

To permit the rotor 28 make the low friction precession movement, the frame 26 comprises (a) an outer ring member 38 having an annular flange 40 protruding toward one of the handles 14, an annular seat 41 extending from the interior of the flange 40 inwardly toward the common axis A and a number of screw holes 42 formed through the seat 41 and (b) an inner ring member 44 mounted on the seat 41 of the outer ring 38 and secured thereto at a number of bores 46, which are threaded at equidistance around the frame 26 at the corresponding locations to the screw holes 42.

Figure 2:
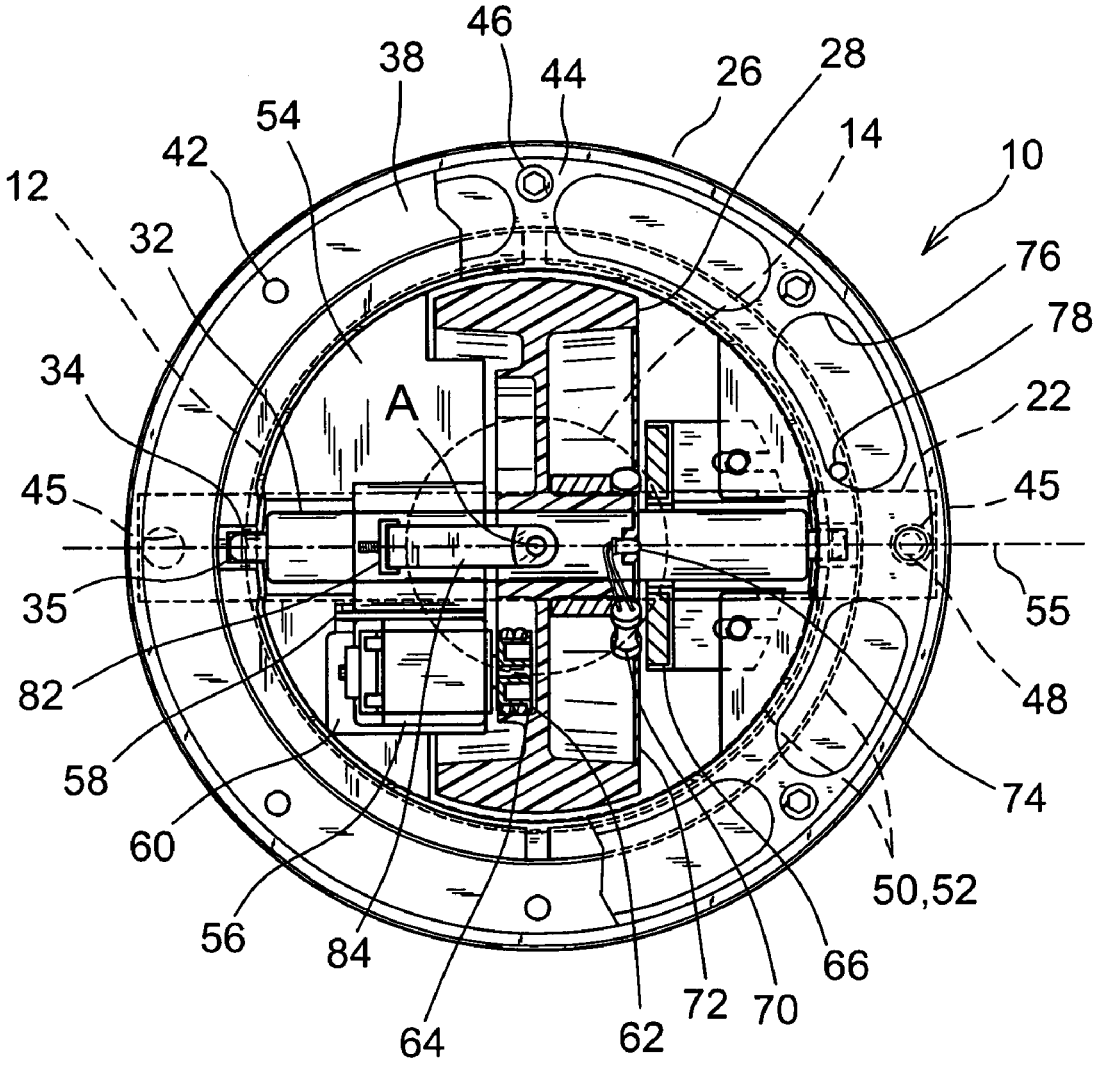
FIG. 2 is a top view in partial cross section of the moving parts of the exerciser of the present invention showing the front of the axle disc mounting the rotor.

One of the arches 22 is also provided with a larger bore 45 at each lateral end thereof right above each bore 46 of the inner ring member 44 while screw holes 47 are formed in alignment with the screw holes 42 of the outer ring member 38, whereby appropriate screws may be driven through the arches 22 and the frame 26 to establish a strong integrity of the exercise device 10. FIG. 2 shows both ring members 38, 44 and arch 22 are secured by one of large screws 48 in the bore 45. The frame 26 may be made from the same metal as used for the arches 22 for the sake of light idle weight and consistency in appearance.

The racetrack 36 is formed by a couple of parallel race inserts 49 press fitted into a lower annular recess 50 formed on the bottom wall of the outer ring member 38 and an opposing upper recess 52 of the inner ring member 44, respectively. For a secure press fit into the recesses 50 and 52, the race inserts 48 have an L-shaped cross section to be lodged well into the corresponding corners of the recesses.

The rotor 28 itself has annular recesses at its axially opposite sides for receiving auxiliary race members including an axle disc 54 that extends coplanar with a spin axis 55 of the axle 32 and longitudinally of the frame 26 to span over most of the open interior space of the annular frame 26. Referring specifically to FIG. 2, the axle disc 54 is shaped like a hollowed out flying disc for aerodynamically stabilizing the processional movement of the rotor 28 at its axle 32. A second race member is a small electric motor 56 in its entirety mounted on the axle disc 54 via a hinge means 58 to corotate with disc 54 about the dynamic axis A of the handles 14 but at the same time operatively engage the rotor 28 to propel the same through an initial rotational lead in either direction about the axle 32, which is perpendicular to the dynamic axis A like in a typical gyroscopic mechanism. A rectangular bay 60 formed on the axle disc 54 receives the motor 56 in a pivoting manner. The motor 56 is in constant operational engagement at its elastic output rotor 62 with a circular track 64 formed on an internal recess of the rotor 28. Without needing a tension, the motor 58 by its own weight pivots about the hinge means 58 to bear against the track 64 and rotates the same to establish a desired precession speed for the exerciser to take over.

The motor 56 may be in a generic type having input rating of 3 volts supplied by the batteries 16, which may be either disposable or rechargeable with a minor modification to the rotor 28 to take the full advantage of a permanent magnet installed as described below.

In the illustrated embodiment, the electric motor 56 is a DC motor. The compact motor 56 has sufficient output to rotate the rotor 28 to an operational angular velocity. Alternatively, the motor 56 can be an AC motor if the power supply 16 is replaced by an appropriate electric connection to receive an AC power source. In one embodiment, the motor 56 can rotate the rotor 28 and generate electricity. The motor 56 receives electricity from the power supply 16 and provides a moment to the rotor 28. Then, a coin shaped magnet 66 fixed stationary to the axle disc 54 through an adjustable bracket 68 and a number of coil elements 70 mounted concentrically on a sleeved mounting board 72 in the rotor 28 can generate electricity from the user driven rotation of rotor 28. Then, a rotational connection may recharge the power supply 16 of rechargeable batteries.

With or without these regenerative power components, the coil elements 70 are connected to corresponding LED elements 74 to illuminate them during operation of the exerciser 10. Each of the coil and LED elements has a perforation in the mounting board 72 to provide unobstructed operations. Those skilled in the art recognize that the motor 56 can be a conventional brushless motor/generator. These conventional motors, e.g., can have a magnet rotor and stationary windings or stator.

The inner ring member 44 as partially shown in FIG. 2 also has multiple circumferential indentations 76 diametrically positioned for reducing the total weight of the exerciser 10 in a balanced manner. In order to provide a quiet and smooth operation of the exerciser 10, one or more of the indentations 76 may have an oil inlet 78 communicating with the racetrack 36 for lubricating the rotational members inside the gyro sphere 12.

Figure 3:
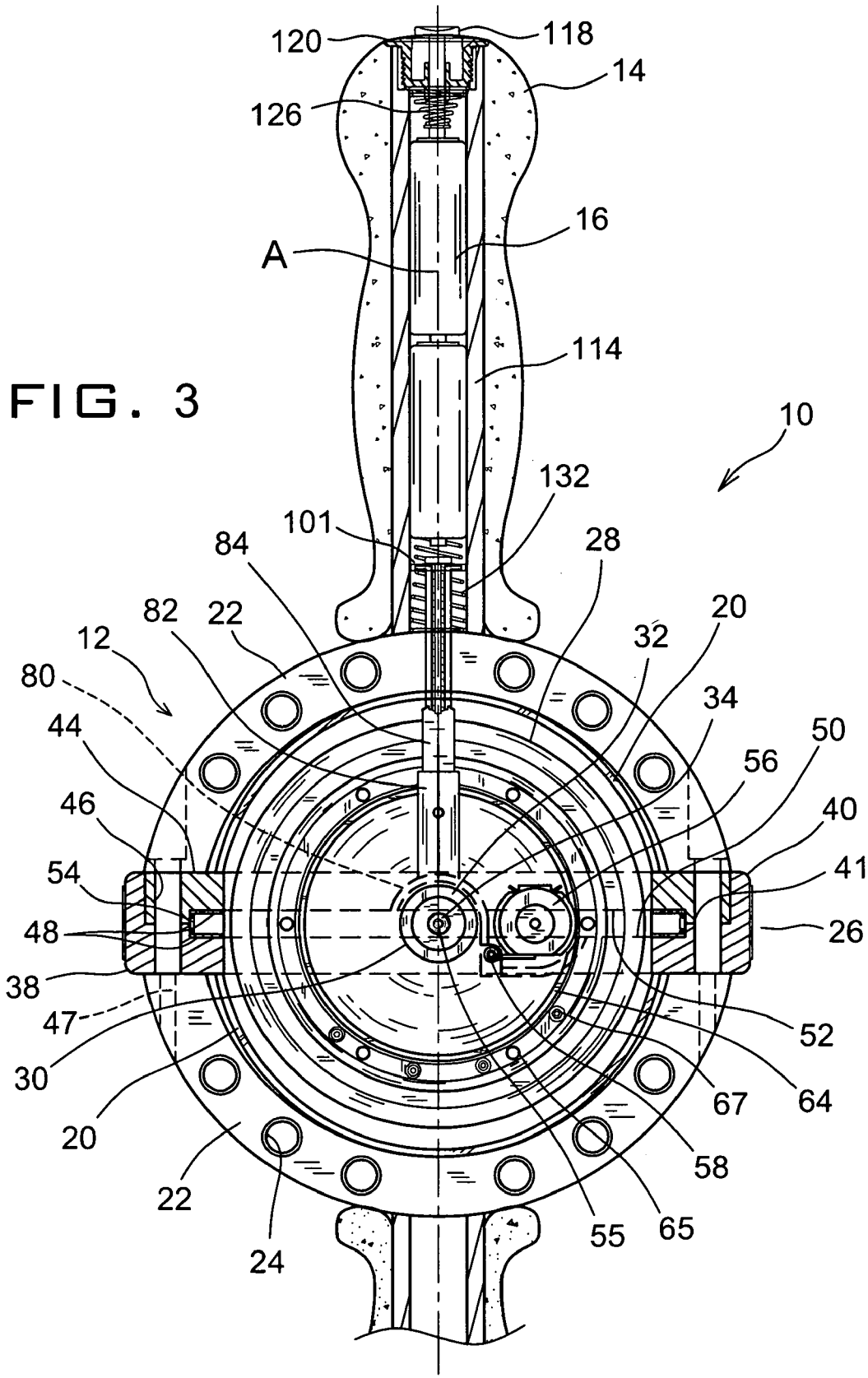
FIG. 3 is an axial side view of the exerciser in FIG. 1 showing the electrical connections to the starting motor according to the present invention.

FIG. 3 illustrates the front view of the positional relationship between the motor 56 and rotor track 64 in their pivotal engagement and the electrical conduit for delivering power in a dynamic setting. The bay 60 of the axle disk 54 for holding the motor 56 merges into an overpass 80, which extends around the axle 32 and has an upright arm 82 for hugging a pair of conductor members 84 centered about the precession axis A for electrically connecting the relatively stationary batteries 16 to the driving and revolving motor 56 about the batteries 16. The motor 56 may have a part of the hinge means 58 welded thereto and mechanically connected to a single shaft of the hinge means 58 and then electrically connected to the conductor members 84 via flexible lead wires not shown.

Outside of the track 64 are formed air holes 65 through the walls of the rotor 28 at even distance from each other to cool both sides of the rotor 28. At locations besides the air holes 65 there may be drilled reductions 67 to balance the weight of the rotor 28 for a smooth precession at any high speed.

Figure 5:
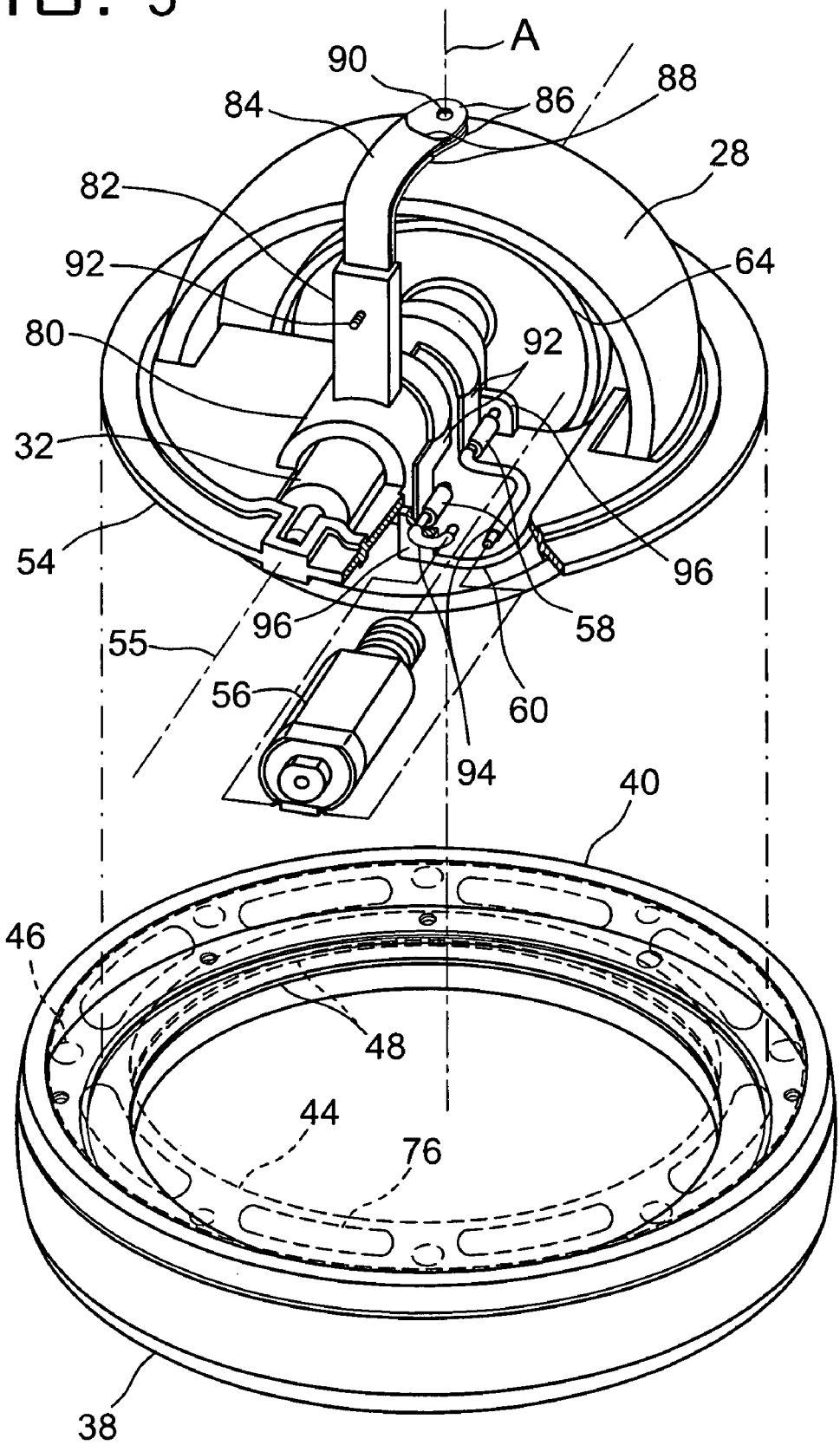
FIG. 5 is an exploded perspective view of the gyroscopic movement inside the gyro sphere according to a second embodiment of the present invention.

As in FIG. 5 showing the second embodiment of the present invention, the hinge means 58 may be integral to the conductor members 84 comprising two superimposed contacts 86, which are made from a conductive metal but insulated from each other by a thin layer of plastic sheath or coating 88. The top one of the contacts 86 is exposed and is provided with an opening 90 while the bottom one of contacts 86 is solid and isolated from the top contact due to the sheath 88. Middle portions of the contact 86 are screw fastened to the arm 82. Although not shown, by having a metal screw 92 first pass a tight hole in the bottom contact and then an enlarged slot in the top contact before it is driven through the arm 82, an unintentional short circuit may be prevented between the contacts 86.

The lower extremities of the conductor members 84 may be shaped into pivot arms 92 that extend along a common axis and are kept isolated. At the same time, a pair of partially sheathed high gauge (thick) wires 94 may be welded to the respective terminals of the motor 56 at one side and shaped into hinge pins at the other side for penetration into the pivot arms 92. The sheath areas of the pivoting wires are preferably glued to the bottom of the motor 56 for an added security.

In addition, the axle disc 54 may provide two opposite upright walls 96 for securing the wires 94 in place where the either tips of the wires 94 may be bent to prevent a possible slippage from the pivot arms 92 while supporting the active load of the motor 56. Thus, by eliminating an unsightly wiring visible from outside, the exerciser 10 is aesthetically improved. At the same time, loose wire sections are eliminated along with any possibilities of operational interference in the high-speed relative movements in the exerciser 10. Retained are more durable contacts and neat look.

Figure 4A:
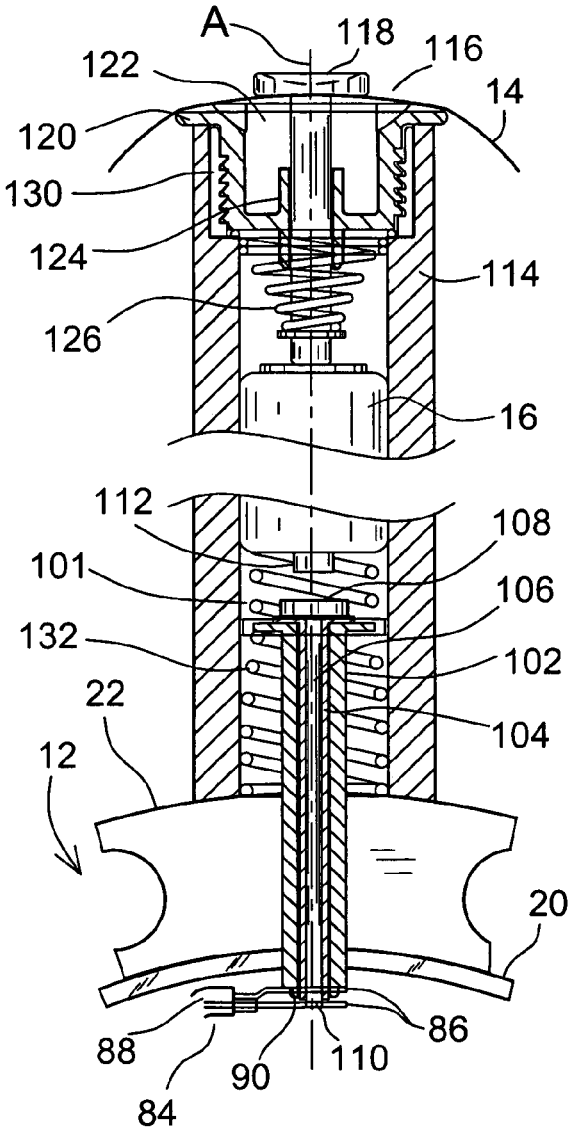
FIG. 4A is an enlarged view of the electric contact mechanism in its normal position with the push switch lifted off according to the present invention.
Figure 4B:
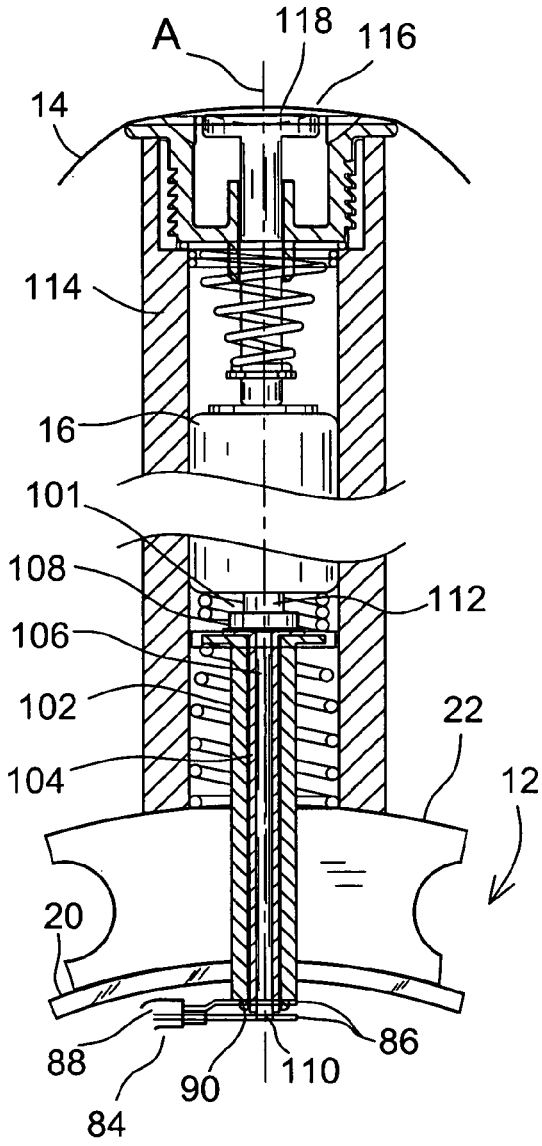
FIG. 4B is an enlarged view of the electric contact mechanism activated with the switch depressed to supply power for turning on the starting motor according to the present invention.

Referring to FIGS. 3, 4A and 4B together, the structure of dynamic power supplying to the start motor 56 will be described. The handle 14 holding the batteries 16 has a switch means uniquely incorporating the batteries themselves to make and break their electric power leading to the motor 56 inside the gyro sphere 12. The power handle 14 comprises a rigid inner tube 66 having an inner diameter to receive the AA sized batteries snugly.

The exerciser 10 comprises the power supply 16 in communication with the power supply conduit 101 and the conductor member 84. The power supply conduit 101 comprises an outer, tubular conductive portion 102, an inner, tubular insulator 104 and a pin shaped center conductor 106, which is inserted in the insulator 104 and protrudes at both the top 108 and bottom 10 to connect one of the opposite terminal polarities of the batteries 16 to the bottom one of the contacts 86 of the conductor member 84. As the conductor member 84 rotates about the precession axis A it is adapted to maintain an uninterrupted electrical connection with the power supply 16 so a dynamic power supply is established.

The bottom contact 110 passes the opening 90 formed on the upper contact 86 of member 84 while being isolated by the insulator 104 from the outer conductive portion 102 so that the center conductor 106 may exclusively connect the illustrative positive terminal 112 of the battery 16 when it is forced to meet the top portion 108 of conductor 106. FIG. 4A shows the position of the battery 16 disconnected at rest while FIG. 4B depicts the same battery 16 at activation. According to the present invention, the handle 14 may comprise a conveniently shaped grip of foam or other elastic material that insulates a frame tube 114 inside. The frame tube 114 is preferably made from a metal, which conducts electricity. Taking advantage of the conductive tube 114, a push switch assembly 116 is installed at the opposite polarity of terminal of the battery series 16 to make or break the power supply with a user's finger.

In case only nonconductive materials are used for the tubular handle 14, it may be made partially conductive along a desired length by inserting a separate metal piece in the handle 14.

In order to make a temporary electrical connection with the battery 16, the switch assembly 116 has a unique push-pull mechanism including a top metal pin 118 held on a threaded lid member 120 of an insulation material like plastic. The lid member 120 has a top opening 122 through which the metal pin 118 may freely pass while holding it slidably in a central guide 124 extending in and out of the lid member 120. The portion of central guide 124 inside of the lid member 120 helps prevent foreign materials or liquid from entering the power supply conduit 101. An inverted conical metal spring 126 is mounted on the bottom surface of the lid member 120. The base peripheral diameter of the conical spring 126 is determined so that it slightly presses against the interior walls of the metal frame tube 114 when the lid 120 is tightened in place in the frame tube 114. Then, a C-ring 128 may secure the spring 126 in place.

At the tube 114 side, the corresponding threads may be formed directly on the inner walls thereof or in a separate plastic sleeve 128 bonded on a top bore 130 formed in the frame tube 114. Thus, the metal pushpin 118 normally protrudes to contact the distal terminal of battery 16. However, a counteracting metal spring 132 is located at the bottom of the frame tube 114 to hold the battery 16 at its insulated end. The strength of expansion of the proximal spring 132 is determined so that it adequately counters the bias of the distal spring 126 plus the weight of the two batteries of AA size when the handle 14 of the exerciser 10 is oriented with the spring 132 down directly toward the center of earth.

Just as the lid spring 126 always touches the battery terminal, the proximal spring 132 electrically contacts the tubular conductive portion 102 in the power supply conduit 101. Due to the own bias the spring 132 has to push away the proximal battery terminal (positive in this case), the spring 132 or battery 16 normally breaks the power line that leads from the distal battery terminal via the biased protruding pin 118, the spring 126, the frame tube 114, spring 132, conductive portion 102, the bottom one of the contacts 82 to both terminals of the motor 56 and back via the top one of the contacts 86 and the center conductor 106 to the opposite battery terminal.

Therefore, during the depression of the pin 118 against the resistance of the spring 132 as shown in FIG. 4B, there is an energy flow between the stationary power supply 16 and the driving and revolving motor 56.

The power supply 16 can also be a rechargeable battery (e.g., Nickel-Cadmium or Nickel Metal Hydride battery) preferably that can be recharged by the rotation of the rotor 28 and the motor 56, which can function as a generator. Thus, the power supply 16 can provide power to the motor 56 and can be recharged as the user operates the device 10. Although not shown there could be power supplies within the opposite handles 14. Alternatively, the handle 14 without the power supply conduit 101 installed may simply work as storage of fresh batteries.

In operation, the power supply 16 provides power to the motor 56, which causes rotation of the rotor 28. The rotor 28 rotates at the operational angular velocity so that the user can start to rotate the handles 14 maintaining the obtained precession of the rotor 28. The steps of may be summarized as follows:

First, the user activates the switch 116 so that power supply 16 provides power to the motor 56. In the illustrated embodiment, the user presses on the pin 118 to have the batteries 16 meet the central conductor 106. While the pin 118 is depressed the power supply 16 provides energy to the motor 56. When the user stops pressing on the pin 118, it returns to outward position under bias equilibrium between springs 126 and 132 and the power supply 16 does not contact the contact conductor 106, so that electrical current will not flow from the batteries 16 to the motor 56. In the hand pulling embodiment, the user only activates the switch after the hand pull.

In one embodiment, the switch 116 can cause the power supply 16 to provide energy to the motor 56 until the rotor 28 reaches a pre-set angular velocity. The switch 116 can be a manual switch or automatic switch (e.g., a electronic controller). For example, the user can activate the switch 116 in the form of an electronic controller, which allows an electrical current from the power supply 16 to drive the motor 56 for a start-up cycle. After a start-up cycle, the rotor 28 reaches the operational angular velocity. The electronic controller 116 receives a signal from a feedback device, such as a velocity sensor, and stops the energy flow from the power supply 16 to the motor 56.

In a second step, the exerciser 10 begins a start-up cycle when the motor 56 uses the energy to start rotating the axle 32. The power supply 16 can provide power to the motor 56 to increase the angular velocity of the axle 32 to thereby increase the angular velocity of the rotor 28. The angular velocity of the rotor 28 is increased until the end of the start-up cycle, preferably when the rotor 28 rotates at the operational angular velocity, such that the user can use the exerciser 10.

In a third step, the rotor 28 achieves the operational angular velocity. After the rotor 28 rotates at the operational angular velocity, the user can release the power flow from the power supply 16 to the motor 56. The rotor 28 can continue to rotate about the axle 32 such that the user can grip the handles 14 with both hands.

In a fourth step, while rotor 28 is rotating about the axle 32, the user can manually move the exerciser 10 in a gyration motion causing precession of the rotor 28. The precession of the rotor 28 provides resistance, a torque, to the user. The user can gyrate the exerciser 10 so that the user feels either a reasonably constant resistance or a varying resistance. For example, the user can start to rotate the exerciser 10 by rowing the handles 14 a cone-like path. The rowing path can be an orbital path, such as a curved path, generally circular path, elliptical path, or the like. Further, the rotor 28 precesses about the axis A.

Because the rotor 28 precesses when the user applies a moment perpendicular to the spin axis 55 and the axis A (precession axis), the user can use a generally rocking motion to cause precession of the rotor 28. In the illustrated embodiment, the axis A is perpendicular to the plane passing through racetrack 36. Thus, the spin axis 55 and the precession axis A are perpendicular. As the user makes the aforementioned movements, the ring guide axle disc 54 and the rotor 28 start to rotate about the precession axis A because the user applies a moment to the axis perpendicular to the spin axis 5 and the precession axis. Thus, the rotor 28 rotates about the spin axis 55 while the spin axis 55 rotates in the plane perpendicular to the axis A. While the rotor 28 precesses, axle disc 54 slides along the racetrack 36. Thus, the shaft axle 32, the rotor 28, the disc 54 and the motor 56 rotate all together about the axis A, preferably while the rotor 28 is rotating about the spin axis 55. The user's motion can increase, decrease, or maintain the angular velocity of rotor 28 about the spin axis 55 and the precession speed of the rotor 28.

The exerciser 10 can be used in various manners for resistance and cardiovascular training. The user can exercise with the exerciser 10 by rotating the same while maintaining the location of the centroid of the rotor 28. Alternatively, the user can exercise with the device 10 by simultaneously translating and rotating the exerciser 10 to workout various muscles, such as the user's biceps, triceps, an deltoids. The user can rotate the device 10 while performing a biceps curl. The user can perform different motions to provide desired resistance to various muscles. Muscles on the user's left and right side of the body can be exercised simultaneously for a time efficient workout. For example, while the user rotates the exerciser 10 causing rotor 28 recessions, the user can perform biceps curls. The resistance to the user can be varied, for example, by varying the radius and/or the speed of the handles 14. Of course, the inertia of the rotor 28 can be varied to change the resistance. For example, the resistance to the user can be increased by forming the rotor 28 from a heavier material or by increasing the moment of inertia of the rotor 28.

The user can rotate the exerciser 10 for resistance and cardiovascular training without having to move their legs. For example, the exerciser 10 can be used while the user is in a sitting position or lying down in bed. The training with exerciser 10 can be performed for an extended period of time, because the user can maintain a smooth rotational motion of the device 10 by using different muscles of the user's body (e.g., back muscles, deltoids, pectorals, biceps, and triceps). Additionally, the device 10 can be used in most indoor settings so that the user can train when the outside environment is not suitable for exercising, such as running or walking. Because the exerciser 10 is used to exercise various large muscle groups simultaneously, the user can obtain vigorous resistance and cardiovascular exercise.

Figure 6:
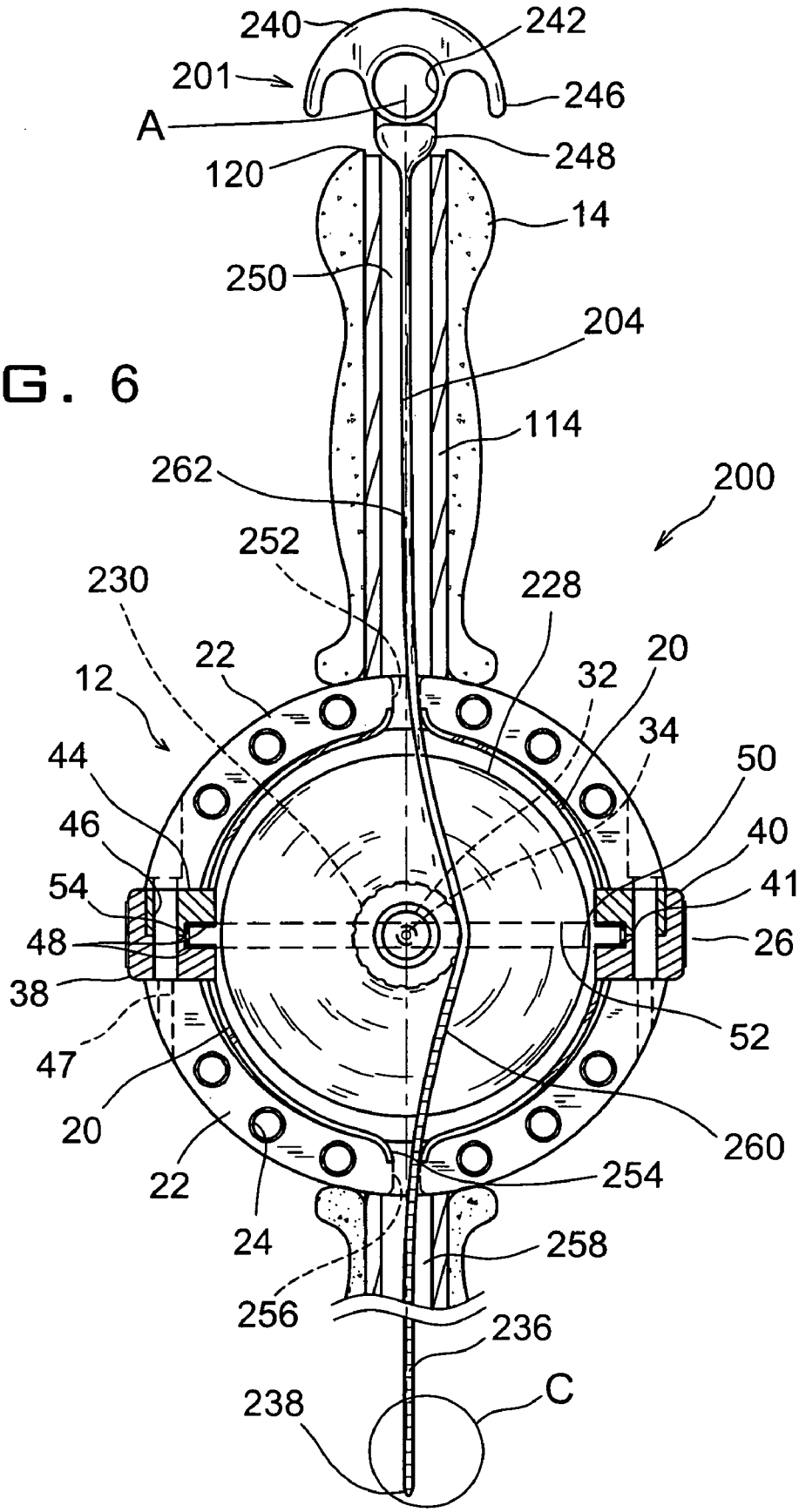
FIG. 6 is a partially cross sectional side view of an exerciser of a third embodiment of the present invention similar to FIG. 3 of the primary embodiment of the invention showing the starting motor replaced by a single pull starter.
Figure 7:
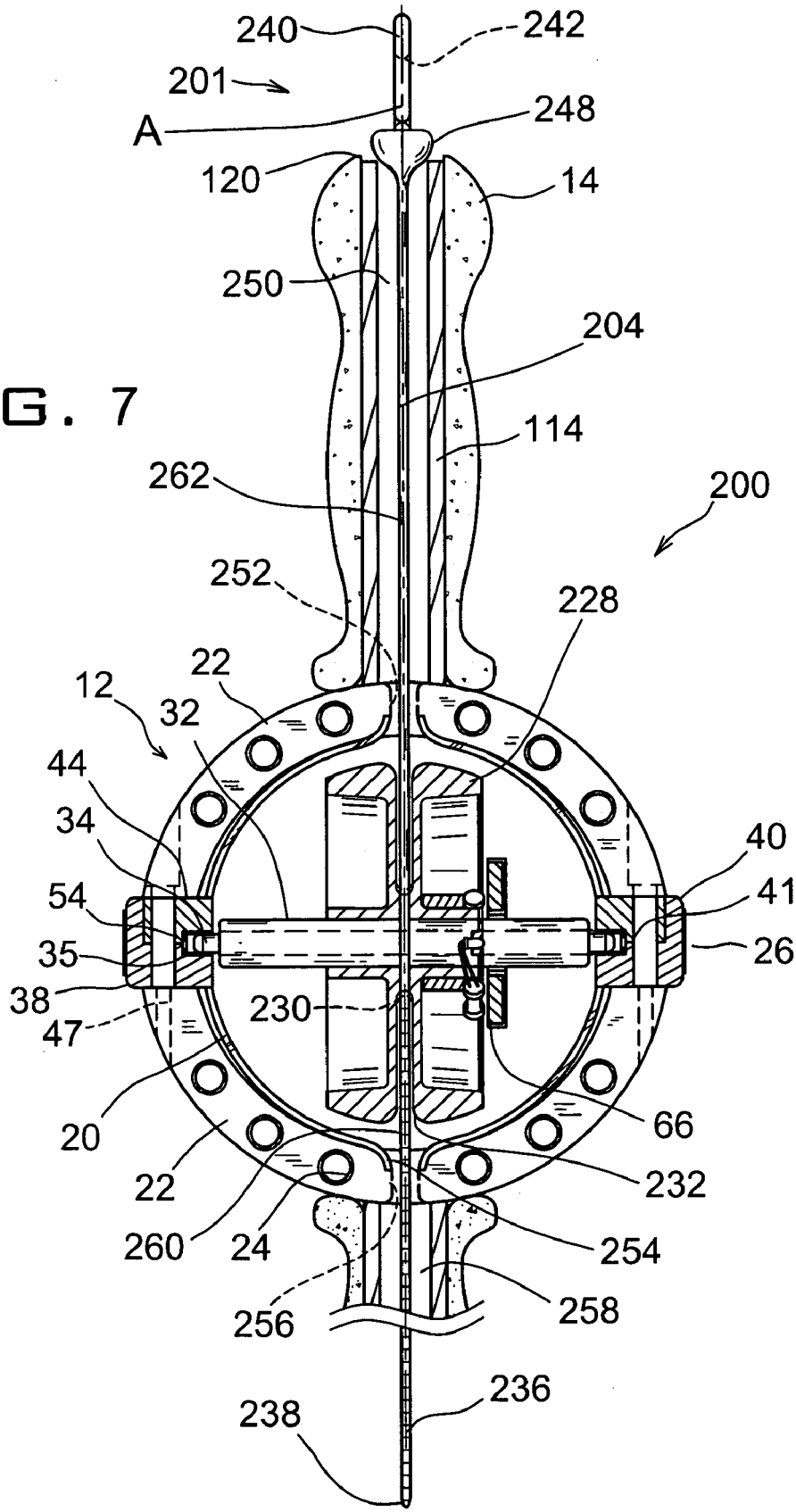
FIG. 7 is a view similar to FIG. 6 with the rotor and the pull starter turned 90 degrees about the axis of the handle to face forward.

Referring to FIGS. 6 and 7 together, a gyroscopic exerciser 200 according to a third embodiment of the present invention will be described wherein the whole gyroscopic exerciser 10 of the first embodiment is greatly simplified by a mere replacement of the electric starter system with a single pull starter 201 for users who prefer a purely manual operation to an assisted start of the exerciser.

The exerciser 200 has substantially the same structure as the exerciser 10 in that the frame 26 is adapted to keep the gyroscopic movement of a core rotor 228 having two simultaneously rotational axes to provide the precessional phenomenon. The rotor 228 may be cast from a metal into the shape of a middle part of a solid sphere with two opposing apexes removed. The rotor 228 has an externally gripping central sleeve 230 for internally receiving the axle 32 that extends in opposite directions to slightly pass the spherical boundary of the precessing rotor 228. The axle 32 becomes one of the two axes about which the rotor 228 may revolve freely in the gyro sphere 12. From both ends of the axle 32 concentric rolling tips 34 extend having their diameters abruptly reduced from the main portion of the axle 32. The tips 34 are then gradually reduced in diameter to provide rounded smooth ends 35 that effect minimum possible frictions due to their high speed relative movements to the racetrack 36 in the frame 26 to slidably guide the tips 34 during the rotor 228 operation.

In addition, the rotor 228 has a deep middle groove 232 that extends from its peripheral surfaces to the grip sleeve 230 as shown in FIG. 7. Alternatively, the rotor 228 may be made by two back-to-back rotor sections threaded by the common axle 32 and spaced by the grip sleeve 230 in between. The sleeve 230 may have toothed surfaces to positively engage the corresponding portions of the pull line 204. As in the enlarged view of FIG. 8, the pull line 204 may be a hybrid of a steel wire core 234 and a plastic skin of contoured surfaces including a series of teeth 236 and a slip tip 238 for gliding along the various interior surfaces of the exerciser 200 during its loading manipulation before the pulling start. The steel core 234 may be a braided wire or a single extension of rod with some resilience. Alternatively, a plastic of high resistance to wear may be singularly used to mold the pull starter 201 as a whole as long as it withstands quick and repetitive axial pulls.

At the opposite end of the slip tip 234 of the pull line 204 is a starter handle 240 having a finger hole 242 through the handle 240 and two side hooks 246 to facilitate positioning of the assisting fingers in pulling the line 204. The handle 240 doubles as a hanger for keeping the starter handle 240 at a secure place during a session of workout. A solid stop 248 is formed under the finger hole 242 to limit the travel of the starter handle 240 into the frame tube 114 in the handle 14 and to maintain a convenient height of the starter handle 240 above the exerciser handle 14.

The pull line 204 preferably has just enough resiliency to penetrate through a tubular space 250 in any upper one of the handles 14, a through hole 252 of the arch 22 aligned with handle space 250, the grip sleeve 230 of the rotor 228 positioned at the center of the middle groove 232 and axially blocking the through hole 252 and thus pushing the line 204 to extend in a deflected route of travel, the converging inner surfaces of the shell 20 at the exit side handle 14 leading to its vertex 254, an opposite through hole 256 directly in line with the through hole 252 and finally a tubular space 258 in the lower handle 14. The forced deflection of the traction section 260 of the pull line 204 against the grip sleeve 230 of the rotor 228 creates an automatic grip force between the two parts effective to turn the rotor in a whip to result in the necessary precessional start of the gyroscopic exerciser 200.

The pull line 204 is divided by a traction section 260 at its distal side and a non-traction section 262 for connecting the traction section 260 to the starter handle 240. The non-traction section 262 has smooth circumferential surfaces. The length of the pull starter 201 may be determined so that when it is fully inserted the slip tip 238 is located near the far end of the exit side handle 14. In order to provide an adequate pull to the rotor 228, the length of the traction section 260 of the pull line 204 is set so that the grip sleeve 230 is revolved at least twice through engagement with the traction section 260. This will normally position the slip tip 238 of the pull line 204 short of or past the exit side handle tip depending on the radius of the grip sleeve 230.

To prevent an accidental pull of the starter 201 into the gyro sphere 12, the non-traction section 262 extends a length that is slightly longer than the distance between the handle tip 120 and the grip sleeve 230. At the same time, the line 204 makes a ratchet engagement with the grip sleeve 230 by directional teeth extensions as shown in FIG. 8.

Thus, pull line 204 is limited to keep an idling contact with the moving parts in the gyro sphere 12 unless the user intentionally propels the rotor 228. In case the pull line 204 is in an advertent reengagement with the grip sleeve 230 of the rotor 228, the solid stop 248 abuts the edges of the handle tip 120 to prevent any damage to the hand.

The manual starter 201 has the added benefit of minimal numbers of moving parts to add and maintain in order to provide a durable exercising device even in harsh exercising conditions.

FIGS. 9 and 10 show sides of a fourth embodiment of the exerciser of the invention having a manual pull starter 301 with a built-in secure device for storage in the exerciser handle 14. The pull starter 301 is identical to the starter 201 except that it also has a solid stop 348 that is threaded to mate with an inward thread 349 formed at an inner handle tip 320 of each of the opposite handles 14. For storage of the exerciser 200, the pull starter 301 may be readily placed in the exerciser from either handle 14 and screwed thereto for holding the total exerciser 200 onto a secure hanger or opening.

To start the exerciser 200, one may release the pull starter 301 first and make the movement of pulling start by holding a starter handle 340. The manual pull starter 301 is preferably stiff yet flexible and resilient enough so that a user can get the rotor up to preferably at least 4000 revolutions per minute on the first pull.

Figure 11:
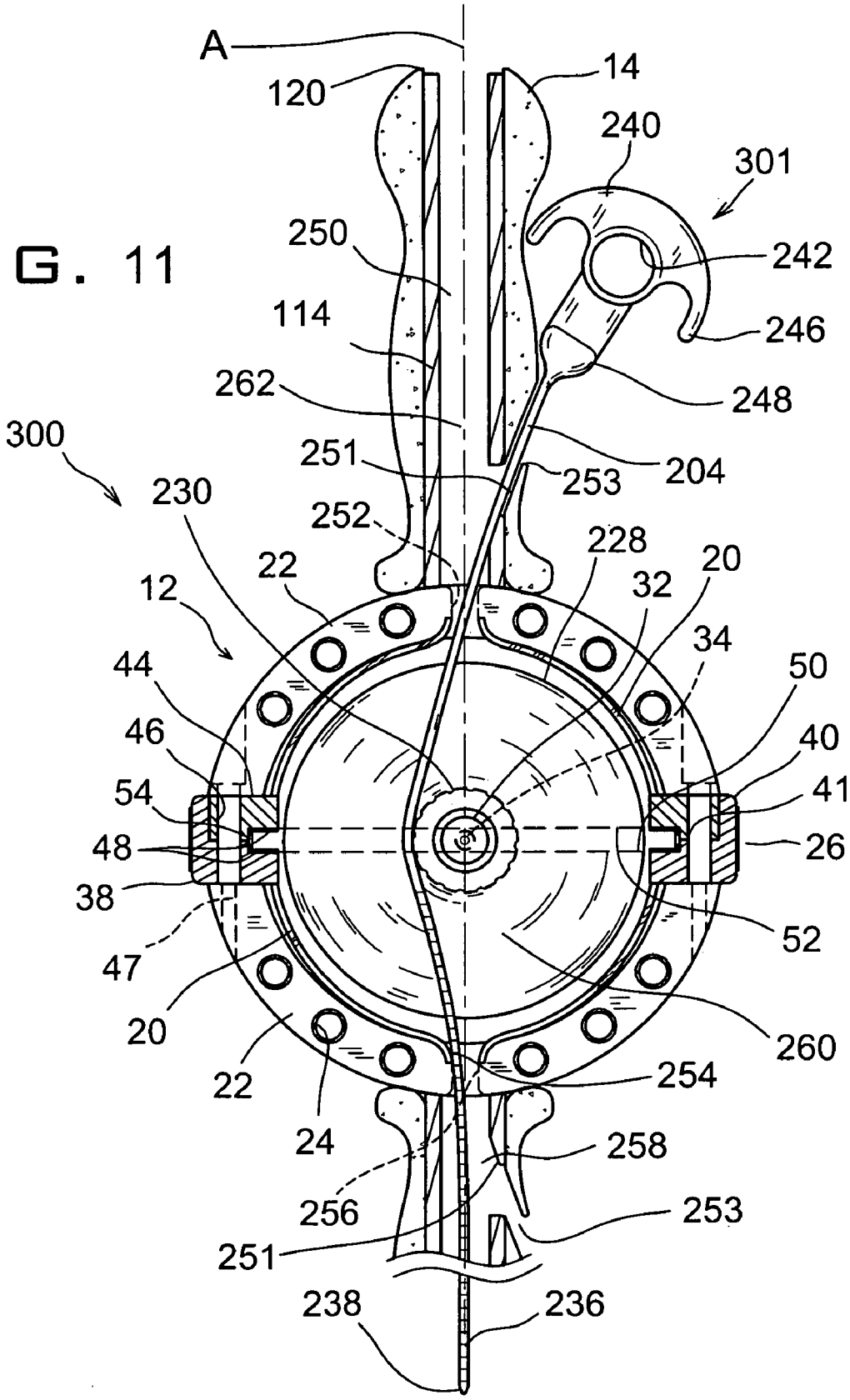
FIG. 11 is a partially cross sectional side view of an exerciser of a fifth embodiment of the present invention similar to the third embodiment of FIG. 6 showing modifications to the position and shape of the of the manual pull starter.

FIG. 11 illustrates an exerciser 300 according to a fifth embodiment of the present invention wherein a pull starter 301 similar to the starter 201 of FIG. 6 is introduced into the tubular space 250 obliquely through a bore 251 formed in the frame tube 114 near its proximal end connected to the arch 22 of the exerciser 300. The bore 251 is angled so that it guides the pull line 204 to freely pass the through hole 252 of the arch 22.

The bore 251 may be made by drilling multiple holes through a side of the frame tube 114 to make a wider interior aperture to facilitate the exit of the pull line 204 at the end of starting exertion. Placing the starter 301 closer to the grip sleeve 230 may reduce the overall length of the pull line 204 while providing the same amount of traction to successfully start the exerciser 300. The handle grip 14 has a corresponding opening 253 with a wider exterior aperture to facilitate the entrance of the slip tip 238 of the pull line 204 into the gyro sphere 12. An identical set of openings may be formed at the opposite handle 14 to provide the ambidexterity for the user convenience.

Figure 12:
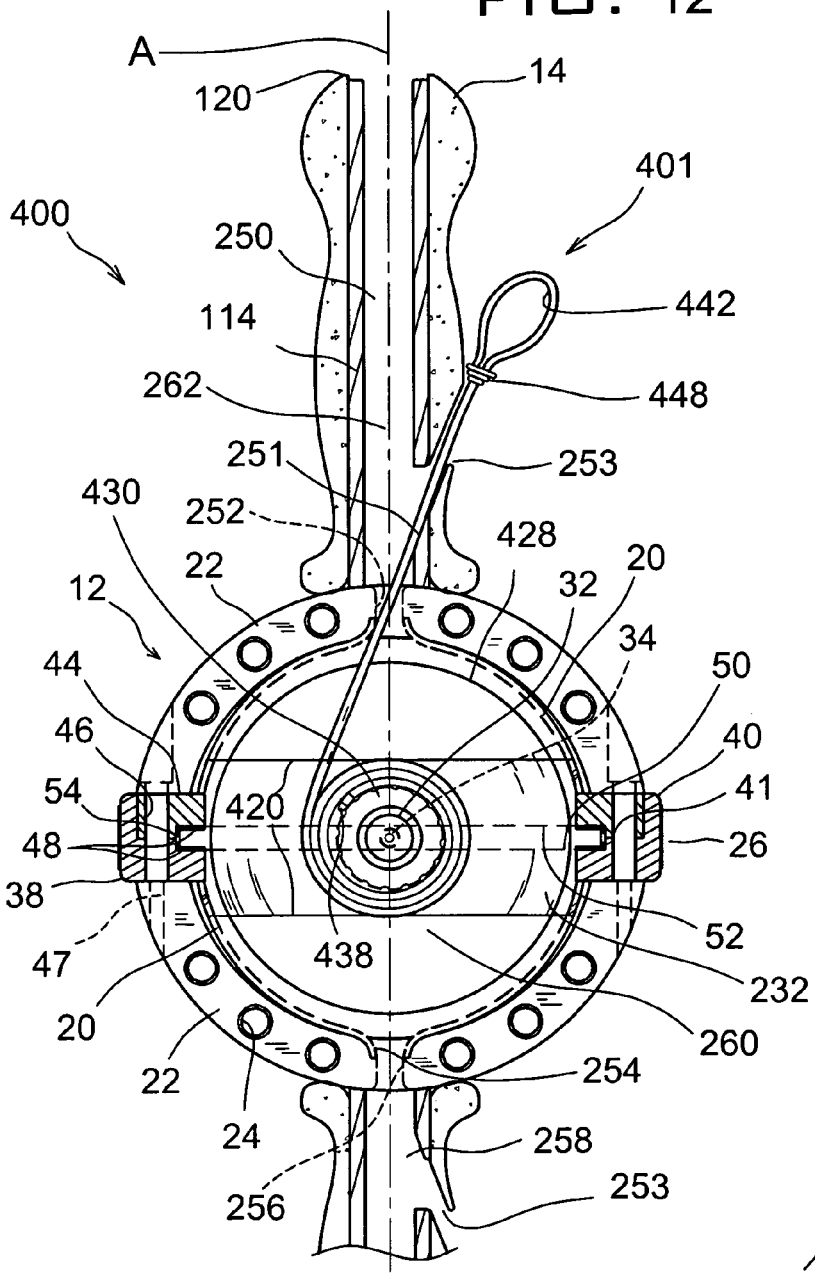
FIG. 12 is a partially cross sectional side view of an exerciser of a sixth embodiment of the present invention wherein the manual pull starter winds and unwinds about the shaft of the rotor.
Figure 13:
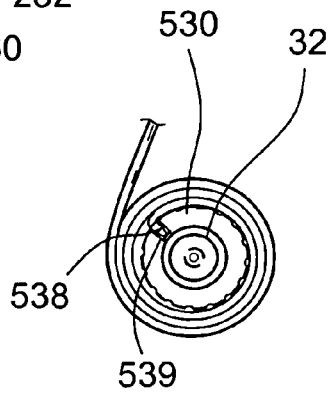
FIG. 13 is a side view of a modified grip sleeve of a rotor having a temporary slot connection between the string and the rotor.

FIG. 12 shows a further simplification of the starting mechanism of an exerciser 400 according to a sixth embodiment of the present invention wherein the manual pull starter is a cut of string 401 with finished ends and may be wound about the shaft of a rotor 428 similar to the rotor 228 of FIG. 7. The string 401 may be a braided or a strand of yarn. Either fabric or plastic yarn is acceptable to make an excellent string 401. A temporary slot connection of the string 401 with the rotor 428 may be made by reinforcing an end of the string 401 with a tiny plastic or metal cap 538 and drilling a bore 539 into a grip sleeve 530 for releasably holding the string end as partially shown in FIG. 13.

The rotor 428 in FIG. 12 has a grip sleeve 430 with fastening surfaces to pick up a tip 438 of the string 401 to start winding the same while allowing a clean break up between them when the string 401 is pulled away. The grip sleeve 430 may be magnetized while the tip 438 of the string 401 is finished with a metallic element so that they attract each other from a distance in order to save the user from pinpointing a connection inside of the rotor 428.

Alternatively, the temporary fastening between the string 401 and the grip sleeve 430 may be provided by a hook-and-loop connection wherein the sleeve 430 is layered with one of hook and loop members and the string 401 is treated at its tip 438 to have an area of the mating loops or hook member.

Top of the string 401 may have a loop 442 by a knot 448 to provide a simple handle for the user as well as a stop for keeping the loop 442 at a convenient position. Upon a complete pull of the string 401 at start up it may be easily wound around the exerciser handle 14 for storage thanks to the high flexure of the string material.

In addition, the shells 20 of the gyro sphere 12 are modified to provide an access aperture 420 close to the outer and inner ring members 38, 44 respectively for the user to wind the string 401 by pushing the exposed rotor 328 in either direction. With several winds around the sleeve 430 the user may quickly pull the string 401 to initiate high-speed revolutions of the rotor 428 to get into the gyroscopic exercise.

The apertures 420 are sufficiently distanced from both handles 14 to avoid an accidental hit of a finger during an exercise. Furthermore, the apertures 420 may be formed at the same lateral side of the arches 22 to limit an unnecessary access to the interior of the gyro sphere 12. By turning the aperture side away from any possible interference during use of the exerciser 400, a complete safety will be assured.

The best mode of this gyroscopic exerciser is to have the handpull bring the speed of the rotor up to a certain speed, before activating the motor. The motor should be sized so that it is good for high-speed acceleration, while leaving the responsibility of the starting and low-speed acceleration to the hand pull. Thus, as a user becomes more experienced in processing the gyroscopic exerciser, the user would not need to use the motor. Therefore, the best mode is currently envisioned as having both the pull device in conjunction with the motor. For a more cost-effective embodiment, or for stronger and more experienced users, the hand pull should be used alone. Furthermore, having a lack of a motor is preferred for simplicity, lack of extra parts that can break down, and also in novelty situations where the lack of electrical starting and pure hand acceleration is fashionable.

Therefore, while the presently preferred form of the gyroscopic device has been shown and described, and several modifications thereof discussed, persons skilled in this art will readily appreciate that various additional changes and modifications may be made without departing from the spirit of the invention, as defined and differentiated by the following claims.

For example, by adding a pedal attachment with straps to the handles 14, the exerciser device 10 may be operated by feet adapted to build up leg muscles. While the user is sitting or laying on a flat surface, he or she may start the rotor electrically or manually and then transfer the exercise device to the foot areas for continuing with cycling motions.

The invention claimed is:

1. A gyroscopic exercise device comprising:

a pair of opposite handles for holding by upper or lower extremities of a user, both handles having interior cavities communicating with each other to accommodate a manual pull starter to cause a gyroscopic start;

a gyroscopic movement unit between the handles having a precession rotor of a truncated and recessed sphere with an internal axle protruding at opposite directions and held to make a rotation about a spin axis extending perpendicular to the handles as well as a revolution about a precession axis extending centrally of the handles, an axle disc having internal openings to receive the axle of the rotor and a circumferential edge received in the racetrack for corotation with the axle, the rotor having a deep middle groove that circumferentially extends from its peripheral surfaces and terminates before the internal axle and a grip sleeve defines the depth of the middle groove and is provided with surfaces to positively engage at least part of the manual pull starter to initiate a high speed precession of the gyroscopic movement unit;

a ring-shaped frame assembly having an outer ring member with an annular flange and a smaller inner ring member received in the flange of the outer ring member and fastened thereto, both ring members having opposing annular recesses for cooperatively holding the top and bottom halves of the racetrack of the gyroscopic movement unit;

a spherical housing for protecting the gyroscopic movement unit from any physical contacts by the user or other external objects but permitting a view of gyroscopic movements of the unit from outside thereof; and a pair of truss members for fastening the handles to the frame assembly at two diametrically opposite locations from the inner and outer ring members.

2. The gyroscopic exercise device of claim 1, wherein the manual pull starter comprises a pull line with a slip tip for gliding along the various interior surfaces of the exercise devise during its loading manipulation before the pulling start, a starter handle at the opposite end of the slip tip having a finger hole through the handle and two side hooks to facilitate positioning of the assisting fingers in pulling the pull line, a solid stop formed under the finger hole to limit the travel of the starter handle into the handle of the gyroscopic exercise device and to maintain a convenient height of the starter handle above the handle.

3. The gyroscopic exercise device of claim 2, wherein the pull line is divided by a traction section at its distal side and a non-traction section for connecting the traction section to the starter handle and has just enough resiliency to penetrate through the cavity in any upper one of the handles, a through hole of a first one of the truss members aligned with the handle cavity, the grip sleeve of the rotor positioned at the center of the middle groove and axially blocking the through hole and thus pushing the pull line to extend in a deflected route of travel, the converging inner surfaces of the spherical housing at the exit side handle leading to its vertex, an opposite through hole directly in line with the through hole of the first truss member and finally a tubular space in the lower handle, whereby the forced deflection of the traction section of the pull line against the grip sleeve of the rotor creates an automatic grip force between the two parts effective to turn the rotor in a whip to result in the necessary precessional start of the gyroscopic exercise device.

4. The gyroscopic exercise device of claim 3, wherein the non-traction section of the pull line extends a length that is slightly longer than the distance between the distal end of the upper side handle of the device and the grip sleeve to limit the pull line to keep an idling contact with the gyroscopic movement unit unless the user intentionally propels the rotor while the pull line makes a ratchet engagement with the grip sleeve by the directional teeth to prevent an accidental pull of the starter into the spherical housing of the exercise device.

5. The gyroscopic exercise device of claim 2, wherein the pull line is a hybrid of a steel wire core and a plastic skin of contoured surfaces including a series of directional teeth.

6. The gyroscopic exercise device of claim 1, wherein each of the inner and outer ring members further has multiple circumferential indentations diametrically positioned for reducing the idle weight of the exercise device.

7. The gyroscopic exercise device of claim 1, wherein the inner ring member further has one or more oil inlets communicating with the racetrack for lubricating the inside of the gyroscopic movement unit in order to provide a quiet and smooth operation of the exercise device.

8. The gyroscopic exercise device of claim 1, wherein the handle of the exercise device comprises a conveniently shaped grip of foam or similar elastic material and a frame tube of a sturdy material.

9. The gyroscopic exercise device of claim 1, wherein the positively engaging surfaces of the grip sleeve have a circle of teeth.

10. The gyroscopic exercise device of claim 1 wherein the manual pull starter comprises a pull line with a slip tip for gliding along the various interior surfaces of the exercise device during its loading manipulation before the pulling start, a starter handle at the opposite end of the slip tip having a finger hole through the handle and two side hooks to facilitate positioning of the assisting fingers in pulling the pull line and a solid stop that is threaded to mate with an inward thread formed at an inner handle tip of each of the opposite handles of the gyroscopic exercise device whereby the pull starter may be readily placed in the exercise device from either device handle and screwed thereto for holding the exercise device onto a secure hanger or opening until a user releases the pull starter first and make the movement of pulling start by holding the starter handle.

11. The gyroscopic exercise device of claim 1 further comprising an annular permanent magnet fixed stationary to the axle disc through an adjustable bracket at one side and a number of coil and illuminating elements mounted to corotate with the axle of the rotor in a close proximity to the magnet for generating an electricity for illuminating inside the gyroscopic movement unit during its operation.

12. The gyroscopic exercise device of claim 1 further comprising an oblique bore formed laterally in the handle near its proximal end connected to the truss member to directly communicate with the interior of the gyroscopic movement unit to guide the manual pull starter from a closer distance into a pulling engagement with the grip sleeve of the rotor.

13. A gyroscopic exercise device comprising:

a pair of opposite handles, at least one handle having an interior cavity to accommodate a manual pull starter;

a gyroscopic movement unit between the handles having a precession rotor with an internal axle protruding at opposite directions and held to make a rotation about a spin axis extending perpendicular to the handles as well as a revolution about a precession axis extending from the handles, an annular racetrack for rotatably holding the spin axle at its opposite ends about the precession axis crossing the longitudinal center of the spin axis, an axle disc having internal openings to receive the axle of the rotor and a circumferential edge received in the racetrack for corotation with the axle, the rotor having a deep groove that circumferentially extends from its peripheral surfaces and a grip sleeve that defines the depth of the middle groove and is provided with temporary fastening surfaces to positively engage and wind a portion of the manual pull starter to initiate a high speed precession of the gyroscopic movement unit;

a ring-shaped frame assembly having an outer ring member with an annular flange and a inner ring member received in the flange of the outer ring member and fastened thereto, both ring members having opposing annular recesses for cooperatively holding the top and bottom halves of the racetrack of the gyroscopic movement unit;

a spherical housing having an opening substantially perpendicular to the at least one handle for protecting the gyroscopic movement unit from an inadvertent physical contact by the user or other external objects while permitting a limited access to the gyroscopic movement unit during the manual gyroscopic pull start.

14. The gyroscopic exercise device of claim 13, wherein each of the inner and outer ring members further has multiple circumferential indentations diametrically positioned for reducing the idle weight of the exercise device.

15. The gyroscopic exercise device of claim 13, wherein the inner ring member further has one or more oil inlets communicating with the racetrack for lubricating the inside of the gyroscopic movement unit in order to provide a quiet and smooth operation of the exercise device.

16. The gyroscopic exercise device of claim 13, wherein the manual pull starter comprises a pull string adapted to be wound about the grip sleeve of the rotor, the pull string having a reinforced end while the grip sleeve has at least one slot to receive the string end to establish a temporary hold between the rotor and the string.

17. The gyroscopic exercise device of claim 13, wherein the manual pull starter comprises a pull string adapted to be wound about the grip sleeve of the rotor, the pull string having a metallic end while the grip sleeve is magnetized to attract the string end to establish a temporary hold between the rotor and the string.

18. The gyroscopic exercise device of claim 13, wherein the manual pull starter comprises a pull string adapted to be wound about the grip sleeve of the rotor, the pull string having an end provided with a hook or loop member of a hook-and-loop fastener while the grip sleeve is layered with a mating loop or hook member to attract the string end to establish a temporary hold between the rotor and the string.

19. The gyroscopic exercise device of claim 13, wherein the handle of the exercise device comprises a conveniently shaped grip of foam or similar elastic material and a frame tube of a sturdy material.

20. The gyroscopic exercise device of claim 13, wherein the positively engaging surfaces of the grip sleeve have a circle of teeth.

21. The gyroscopic exercise device of claim 13 further comprising an oblique bore formed laterally in the handle near its proximal end connected to the truss member to directly communicate with the interior of the gyroscopic movement unit to guide the manual pull starter from a closer distance into a pulling engagement with the grip sleeve of the rotor.

22. The gyroscopic exercise device of claim 13 further comprising an annular permanent magnet fixed stationary to the axle disc through an adjustable bracket at one side and a number of coil and illuminating elements mounted to corotate with the axle of the rotor in a close proximity to the magnet for generating an electricity for illuminating inside the gyroscopic movement unit during its operation.

23. The gyroscopic exercise device of claim 13, wherein the internal axle of the precession rotor has opposite tips of a reduced diameter having a semi-spherical end for reducing a frictional contact within the racetrack.

* * * * *